US005501081A

United States Patent [19]

Mori et al.

[11] Patent Number: 5,501,081

[45] Date of Patent: Mar. 26, 1996

[54] AUGER TYPE ICE MAKING MACHINE

[75] Inventors: Kazuhiro Mori, Toyoake; Naoya Uchida; Susumu Tatematsu, both of Nagoya, all of Japan

[73] Assignee: Hoshizaki Denki Kabushiki Kaisha, Toyoake, Japan

[21] Appl. No.: 365,456

[22] Filed: Dec. 28, 1994

[30] Foreign Application Priority Data

Dec. 28, 1993 [JP] Japan ..... 5-070493

[51] Int. Cl.[6] ..... F25C 1/14

[52] U.S. Cl. ..... 62/135; 62/354

[58] Field of Search ..... 62/137, 354, 135

[56] References Cited

U.S. PATENT DOCUMENTS

| | | | |
|---|---|---|---|
| 4,982,573 | 1/1991 | Tatematsu et al. | 62/135 |
| 4,986,081 | 1/1991 | Hida et al. | 62/135 X |
| 5,440,892 | 8/1995 | Tatematsu et al. | 62/254 X |

*Primary Examiner*—William E. Tapolcai
*Attorney, Agent, or Firm*—Nikaido, Marmelstein, Murray & Oram

[57] ABSTRACT

An auger type ice making machine having an upright evaporator housing the interior of which is formed with a cylindrical freezing surface, an auger mounted for rotary movement within the evaporator housing and drivingly connected at its lower end with an electric motor to scrape ice crystals off the freezing surface and to advance the scraped ice crystals toward an upper end of the evaporator housing, an extrusion head fixed in place within the upper end portion of the evaporator housing to compress the scraped ice crystals advanced thereto by rotation of the auger and extrude the compressed ice crystals upwardly, a drain pipe provided with an electrically operated drain valve and connected to a lower end portion of the evaporator housing to discharge supplied water from the evaporator housing when the drain valve is opened by its energization and an electric heater mounted on an outer periphery of the evaporator housing at a place corresponding with the extrusion head, wherein the electric heater is energized when applied with a halt signal of ice making operation and deenergized after lapse of a predetermined time, and the drain valve is energized after or before the electric heater has been deenergized.

9 Claims, 6 Drawing Sheets

AUGER TYPE ICE MAKING MACHINE

BACKGROUND OF THE INVENTION

1. Field of the Invention

The present invention relates to an auger type ice making machine capable of discharging the supplied water from the evaporator housing and washing the interior of the evaporator housing during halt of ice making operation of the machine.

2. Discussion of the Prior Art

Since an auger type ice making machine is designed for continuously forming ice crystals within the evaporator housing, the supplied water causes adherence of scales to the internal surfaces of the evaporator housing, resulting deterioration of the ice making performance, an increase of load acting on the auger and defacement of the support bearings of the auger shaft. To avoid such problems, a discharge pipe with a drain valve is connected to a bottom portion of the evaporator housing to discharge the supplied water therefrom when the ice making operation is halted for washing. However, if the extrusion head of the ice making machine is in an air-tight condition due to the ice compacted therein, sufficient ventilation at the upper end portion of the evaporator housing may not be obtained to cause insufficient discharge of the supplied water from the evaporator housing and insufficient supply of fresh water for washing. As a result, the washing effect becomes lower, and the interior of the evaporator housing is frozen in excess if the supply of fresh water is insufficient at restart of the ice making operation.

In Japanese Utility Model Publication 62-7980, there is disclosed an auger type ice making machine in which an electric heater is mounted on the outer surface of the evaporator housing at a place corresponding with the extrusion head to be energized when the supplied water is discharged from the evaporator housing for washing. In such a conventional ice making machine, a washing timer is provided to be closed at a predetermined time interval for opening the drain valve and energizing the electric heater for a predetermined time and to be opened for closing the drain valve and deenergizing the electric heater after lapse of the predetermined time. Under control of the washing timer, it is not necessary to maintain the electric heater in its energized condition at least during the latter half of the predetermined time. Accordingly, the energization time of the electric heater becomes too long to cause use less consumption of the electric power, and the evaporator housing is heated in excess to cause loss of the electric energy at restart of the ice making operation.

To avoid such a problem as described above, it has been proposed to open the drain valve and energize the electric heater when a stored ice detection switch has been opened by ice fully stored in an ice storage bin and to close the drain valve and deenergize the electric heater when the stored ice detection switch is closed. Under such control of the stored ice detection switch, however, the energization time of the electric heater is prolonged if the stored ice is not consumed for a long time. As a result, the electric power is consumed uselessly, and the evaporator housing is heated In excess to cause loss of the electric energy at the time when the stored ice detection switch is closed to restart the ice making operation. It has been also proposed to provide a manually operated washing switch which is arranged to open the drain valve and energize the electric heater when it has been operated. In this case, however, washing of the evaporator housing would not be effected if the user forgot to operate the washing switch.

SUMMARY OF THE INVENTION

It is, therefore, a primary object of the present invention to provide an auger type ice making machine capable of effecting ventilation at an upper end portion of the evaporator housing for sufficient washing and supply of fresh water during halt of ice making operation without causing the problems described above.

According to the present invention, the object is accomplished by providing an auger type ice making machine having an upright evaporator housing the interior of which is formed with a cylindrical freezing surface, an auger mounted for rotary movement within the evaporator housing and drivingly connected at its lower end with an electric motor to scrape ice crystals off the freezing surface and to advance the scraped ice crystals toward an upper end of the evaporator housing, an extrusion head fixed in place within the upper end portion of the evaporator housing to compress the scraped ice crystals advanced thereto by rotation of the auger and extrude the compressed ice crystals upwardly, a discharge pipe provided with an electrically operated drain valve and connected to a lower end portion of the evaporator housing to discharge supplied water from the evaporator housing when the drain valve is opened by its energization, an electric heater mounted on an outer periphery of the evaporator housing at a place corresponding with the extrusion head, detection means for issuing a halt signal of ice making operation of the machine when an ice storage bin of the machine is filled with the ice supplied with the evaporator housing, and control means for halting the electric motor when applied with the halt signal, wherein the control means comprises means for energizing the electric heater when applied with the halt signal from the detection means and means for deenergizing the electric heater after lapse of a predetermined time and for energizing the drain valve after or before lapse of the predetermined time.

According to an aspect of the present invention, the detection means is in the form of a stored ice detection switch arranged to be operated for issuing a halt signal when a predetermined amount of ice is stored in the ice storage bin.

According to another aspect of the present invention, the auger type ice making machine further includes a washing timer to be operated at a predetermined time interval for issuing a halt signal of ice making operation of the machine, wherein the electric heater is energized in response to the halt signal applied from the washing timer and deenergized after lapse of the predetermined time and the drain valve is energized after or before lapse of the predetermined time.

According to a further aspect of the present invention, the control means comprises means for deenergizing the electric heater when the electric motor has been halted by the halt signal applied from the detection means.

According to an aspect of the present invention, there is provided an auger type ice making machine having an upright evaporator housing the interior of which is formed with a cylindrical freezing surface, an auger mounted for rotary movement within the evaporator housing and drivingly connected at its lower end with an electric motor to scrape ice crystals off the freezing surface and to advance the scraped ice crystals toward an upper end of the evaporator housing, an extrusion head fixed in place within the upper end portion of the evaporator housing to compress the scraped ice crystals advanced thereto by rotation of the auger and extrude the compressed ice crystals upwardly, a discharge pipe provided with an electrically operated drain valve and connected to a lower end portion of the evaporator housing to discharge supplied water from the evaporator housing when the drain valve is opened by its energization, an electric heater mounted on an outer periphery of the evaporator housing at a place corresponding with the extrusion head, and control means for supplying fresh water into the evaporator housing when applied with a start signal of ice making operation in a condition where the drain valve is closed and for stopping the supply of fresh water when the water level in the evaporator housing rises up to a predetermined level, wherein the control means comprises means for energizing the electric heater when applied with the start signal of ice making operation and for deenergizing the electric heater after lapse of a predetermined time.

BRIEF DESCRIPTION OF THE DRAWINGS

Other objects, features and advantages of the present invention will be more readily appreciated from the following detailed description of a preferred embodiment and certain modifications thereof when taken together with the accompanying drawings, in which.

DESCRIPTION OF THE PREFERRED EMBODIMENTS

Figure 1:
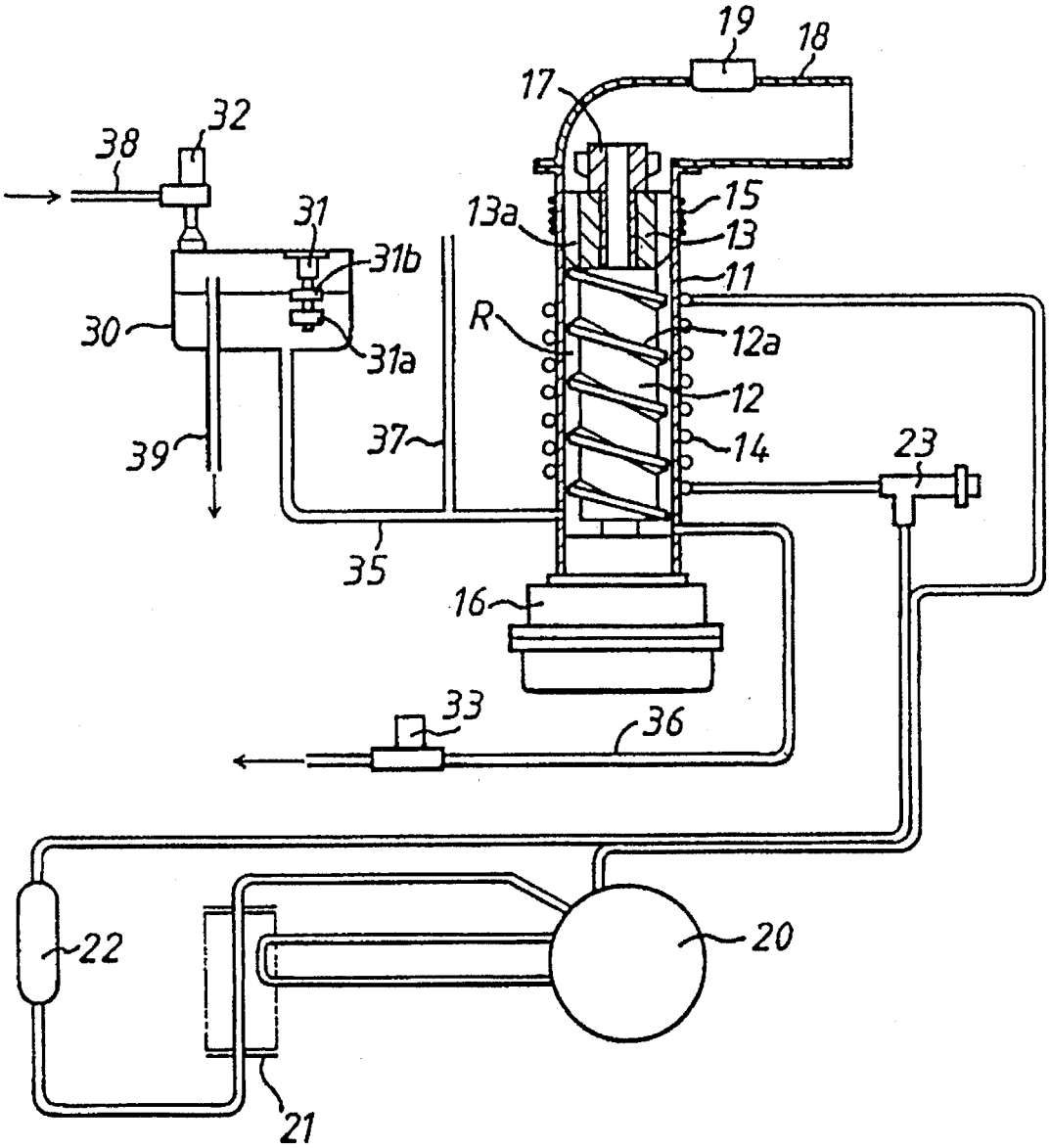
FIG. 1 is a schematic illustration of an auger type ice making machine.

In FIG. 1 of the drawings, there is illustrated an auger type ice making machine which has an upright cylindrical evaporator housing 11 mounted on a casing of a geared motor 16 and an auger shaft 12 mounted for rotation within the evaporator housing 11 and connected at its lower end with an output shaft of the geared motor 16. In a cylindrical ice making space R between the evaporator housing 11 and the auger shaft 12, the helical blade 12*a* of auger shaft 12 is positioned to scrape ice crystals formed on the internal freezing surface of housing 11 and advance them upwardly in accordance with rotation of the auger shaft 12. An extrusion head 18 is coupled within an upper end portion of the evaporator housing 11 and fixed in place by a fastening screw (not shown). An evaporator coil 14 is wound around the evaporator housing 11 and covered with a heat-resistant material (not shown).

The extrusion head 13 is formed with an axial bore rotatably coupled with an upper small diameter portion of the auger shaft 12 through a cylindrical thrust sleeve and formed at its outer peripheral portion with a plurality of circumferentially spaced axial grooves 13*a* associated with the internal surface of freezing housing 11 to form a plurality of circumferentially spaced axial passages. A cutter 17 is fixed to the upper end of auger shaft 12 extending upwardly from the extrusion head 13. An ice melting electric heater 15 in the form of an insulated electric wire is wound around the outer surface of evaporator housing 11 at a place corresponding with the extrusion head 13 and connected to a bimetal thermal sensor 42 shown in FIG. 2, which sensor 42 acts to interrupt supply of the electric power to the electric heater 15 when the temperature of freezing housing 11 exceeds a predetermined value. An ice discharge duct 18 is mounted on the upper end of evaporator housing 11 to cover the cutter 17 and is opened at its outer end toward the interior of an ice storage bin (not shown). An ice detection switch 19 is mounted within an upper horizontal portion of the discharge duct 18 to be operated by an increase of the internal pressure of the discharge duct 18 caused by ice discharged from the evaporator housing 11 after the ice storage bin is filled with ice. Alternatively, the ice detection switch 19 may be mounted within the ice storage bin to be operated when a predetermined amount of ice has been stored.

Figure 2:
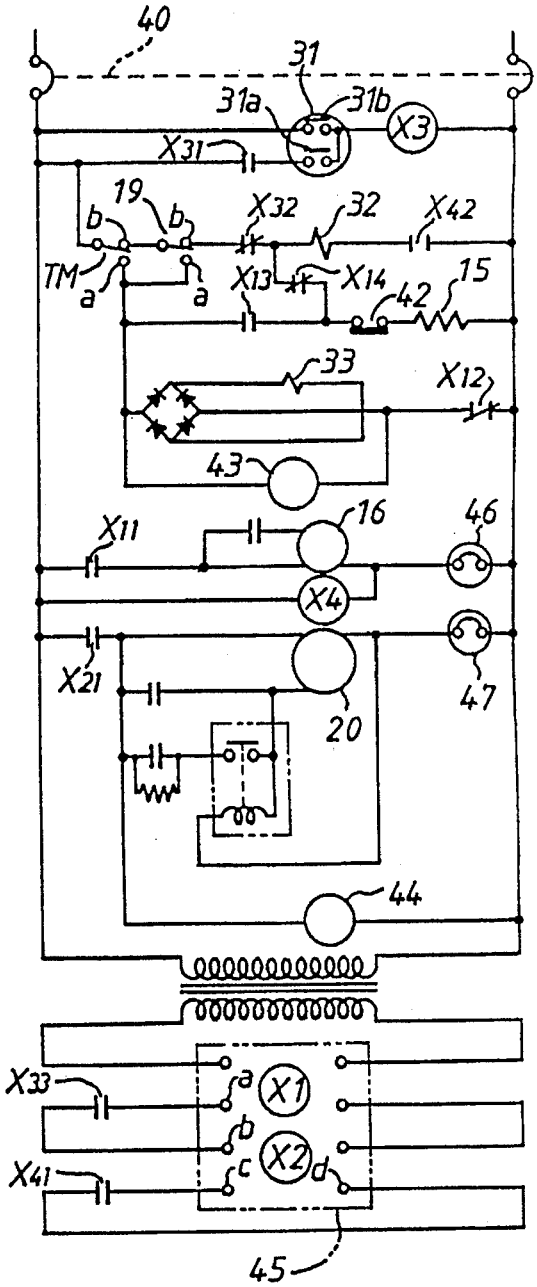
FIG. 2 is a diagram of an embodiment of an electric control circuit for the ice making machine shown in FIG. 1.

A refrigeration circuit of the ice making machine includes a refrigerant compressor 20 connected to the evaporator coil 14, a condenser 21 arranged to be cooled by a cooling fan 44 shown in FIG. 2, a dryer 22 and an expansion valve 23. The water supply system of the ice making machine is composed of a water supply pipe 38 provided with a water supply valve 32, a water tank 30 provided with a float switch assembly 31 and an overflow pipe 39 and an ice making water supply pipe 35 which is provided with a water level gauge 37 and connected at its opposite ends to the bottom of water tank 30 and a lower end portion of evaporator housing 11. The drain system of the ice making machine is composed of a drain pipe 36 which is provided with a drain valve 33 and connected to the lower end portion of evaporator housing 11.

The float switch assembly 31 in water tank 30 has a lower level switch 31*a* of the normally open type arranged to be closed when the water level in tank 30 lowers below a lower limit level and an upper level switch 31*b* of the normally open type arranged to be closed when the water level in tank 30 rises up to an upper limit level. Under control of the level switches 31*a*, 31*b* of float switch assembly 31, the water supply valve 32 is opened or closed as described later to maintain the water level in tank 30 in a range between the upper and lower limit levels during ice making operation of the machine.

Illustrated in FIG. 2 is an electric control circuit for controlling each operation of the geared motor 16, refrigerant compressor 20, water valve 32, drain valve 33 and cooling fan 44 in response to input signals applied from the level switches 31*a*, 31*b*, the ice detection switch 19 and a washing timer TM through relays X1, X2 and a timer board 45 and relays X3, X4. The ice detection switch 19 is normally retained at a "b" contact side to be switched over to an "a" contact side when detected an increase of the internal pressure of discharge duct 18. The washing timer TM is normally retained at a "b" contact side to operate when applied with the electric power and is switched over to an "a" contact side at an interval of a predetermined time (for instance, twelve hours) to be retained at the "a" contact side for a predetermined time. In the ice making machine, a power source switch 40 is provided to be closed in a condition where the ice detection switch 19 and washing timer TM are retained at their "b" contact sides. Ice making operation of the machine is started when an amount of fresh water is supplied to rise the water level in tank 30 up to the upper limit level and is halted by electric signals applied from the ice detection switch 19 and washing timer TM under control of the timer board 45 as described later. The relays X1, X2, X3 and X4 are associated with contacts "X11–X14", "X21", "X31–X33" and "X41, X42", respectively.

Hereinafter, the operation of the ice making machine will be described with reference to FIGS. 1 and 2. When the power source switch 40 is closed, the water supply valve 32 is opened by the electric power supplied from the electric power source through the contact X32 of relay X3 and the contact X42 of relay X4 to supply fresh water into the water tank 30, and the electric heater 15 is energized by the electric power supplied from the power source through the contact X14 of relay X1 and the bimetal thermal element 42. When the water level in tank 30 rises over the lower limit level by supply of the fresh water, the lower level switch 31*a* of float switch assembly 31 is closed but the relay X3 may not be energized since the contact X31 of relay X3 is still opened. When the water level in tank 30 rises up to the upper limit level, the upper level switch 31*b* is closed to energize the relay XS. Thus, the contact X31 of relay X3 is closed, and the contact X32 of relay X3 is opened to close the water supply valve 32 and to deenergize the electric heater 15. Accordingly, the energization time of electric heater 15 at start of the ice making operation is controlled to be the same as the supply time of fresh water.

When the contact X33 is closed by energization of the relay X3 to short terminals "a" and "b" of the timer board 45, an electronic timer (not shown) in the timer board 45 starts to first energize the relay X1. In turn, the contact X11 is closed by energization of the relay X1 to activate the geared motor 16. After lapse of a predetermined time (for instance, 60.seconds), the relay X2 is energized under control of the electronic timer to close the contact X21 so that the refrigerant compressor 20 and cooling fan 44 are activated to start ice making operation of the machine. During the ice making operation, ice rods extruded from the extrusion head 13 are broken by the cutter 17 into lee pieces, and the discharge duct 18 introduces the ice pieces into the ice storage bin. Since the contact X31 of relay X3 is connected in series with the lower level switch 31*a*, the relay X3 is energized when the water level in tank 30 rises up to the upper limit level and is deenergized when the water level in tank 30 lowers below the lower limit level.

When the water level in tank 30 lowers below the lower limit level due to consumption of the fresh water during the ice making operation, the lower level switch 31*a* is opened to deenergize the relay X3. When the contact X32 is closed by deenergize of the relay X3, the water valve 32 is opened to supply fresh water into the water tank 30. In this instance, the contact X33 is opened by the deenergize of relay X3 but the relay X1 is still being energized for a first predetermined time (for instance, 90 seconds) and the relay X2 is also maintained in its energized condition for a second predetermined time (for instance, 150 seconds). While the relays X1 and X2 are being energized, the contact X14 is maintained in its open position to maintain the electric heater 15 in its deenergized condition, and the contacts X11, X21 are maintained in their closed positions to maintain the ice making operation of the machine. In a condition where the water pressure in the water supply pipe 38 is normal, the water level in tank 30 rises up to the upper limit level within the first predetermined time to close the upper level switch 31*b* for energization of the relay X3. Thus, the contact X32 is opened by the energization of relay X3 to close the water valve 32. During the ice making operation of the machine described above, the water tank 30 is intermittently supplied with fresh water to maintain the water level in a range between the upper and lower limit levels, and the electric heater 15 is maintained in its deenergized condition.

When the internal pressure in discharge duct 18 increases due to the ice pieces discharged from the evaporator housing 11 after the ice storage bin has been filled with the ice pieces supplied by the ice making operation of the machine, the ice detection switch 19 is switched over to the "a" contact side issue a halt signal of the ice making operation. As a result, the electric heater 15 is energized by the electric power applied through the contact X13 of relay X1 to heat the outer surface of evaporator housing 11 at a place adjacent the extrusion head 13. In this instance, the ice making operation is maintained until the water level in tank 30 lowers below the lower limit level to open the lower level switch 31*a*. When the lower level switch 31*a* is opened to deenergize the relay X3, the contact X32 of relay X3 Is closed but the contact X33 of relay X3 is still maintained in its open position since the ice detection switch 19 is retained at the "a" contact side. Thus, the water valve 32 is still maintained in a closed condition.

While the contact X33 is being opened, the relay X2 is deenergized under control of the timer board 45 after lapse of a predetermined time (for Instance, 90 seconds). When the contact X21 is opened by deenergize of the relay X2, the refrigerant compressor 20 is deactivated to halt the, ice making operation. After further lapse of a predetermined time (for instance, 60 seconds), the relay X1 is deenergized under control of the timer board 45 to open the contacts X11, X13 and to close the contact X12. As a result, the geared motor 16 and electric heater 15 are deenergized, and the drain valve 33 is opened to discharge the supplied water from the evaporator housing 11 and water supply pipe 35. While the drain valve 33 is being opened, a pilot lamp 43 is lighted to inform of the user that the evaporator housing 11 is being washed. From the above description, it will be understood that the energization time of the electric heater 15 during halt of the ice making operation is defined by the sum of the consumption time of the ice making water (the time during which the water level in tank 30 lowers below the lower limit level In the ice making operation of the machine) and the delay time determined by the timer board 45 for halting the geared motor 16 (the time (90 seconds+60 seconds) during which the geared motor 16 is halted after the contact X33 was opened).

During halt of the ice making operation, the ice compacted in the extrusion head 13 is molted by the heat of electric heater 15 to ensure ventilation at the upper end portion of evaporator housing 11 thereby to ensure the discharge of the supplied water from the evaporator housing 11 and the water supply system. Although in the embodiment the drain valve 33 has been opened at the same time as halt of the geared motor 16, the contact X12 may be replaced with a relay contact to be inclosed by deenergization of the relay X2 thereby to open the drain valve 33 at the time when the refrigerant compressor 20 has been halted.

In such a modification, the auger 12 is driven by operation of the geared motor 16 after stopping of the refrigerant compressor 20 to stir the water in evaporator housing 11 for drainage. This is effective to enhance the washing effect of the evaporator housing 11.

When the ice in the storage bin is consumed, the ice detection switch 19 is returned to the "b" contact side to close the drain valve 33 by interruption of the electric power applied thereto and to energize the electric heater 15. Thus, the ice making machine is returned to the initial condition where the water valve 32 is opened by the power applied through the contact X32 to supply fresh water into the water tank 30. When the upper level switch 31*b* is closed by rise of the water level in tank 30, the relay X3 is energized to open the contact X32. When the contact X32 is opened by energization of the relay X3, the water supply valve 32 is closed, and the electric heater 15 is deenergized. Thereafter, the geared motor 16 is activated under control of the electronic timer in the timer board 45, and the refrigerant compressor 20 is activated after lapse of the predetermined time to restart the ice making operation.

If in the above-described operation the ice detection switch 19 was returned to the "b" contact side in a short time or the ambient temperature was low, the ice compacted in the extrusion head 13 would not be fully molten. In the embodiment, however, the extrusion head 13 is heated by the electric heater 15 until the water level in tank 30 rises up to the upper limit level. Thus, the ice compacted in the extrusion head 13 can be fully molten to ensure ventilation at the upper end portion of evaporator housing 11 thereby to ensure supply of the fresh water into the evaporator housing 11 from the water tank 30. This is effective to avoid excessive freeze of the evaporator housing 11 caused by insufficient supply of the water at restart of the ice making operation.

As is understood from the above description, the water drain and washing of the evaporator housing 11 are conducted in such a manner that the supplied water is discharged from the evaporator housing 11 and the water supply system when the ice detection switch 19 is switched over to the "a" contact side to halt the ice making operation and that the evaporator housing 11 is supplied with fresh water when the ice detection switch 19 is returned to the "b" contact side to restart the ice making operation. The electric control circuit shown in FIG. 2 may be further provided with a washing timer TM in parallel with the ice detection switch 19. In such a case, the ice detection switch 19 is arranged to be switched over to the "a" contact side when the ice storage bin is filled with:the supplied ice pieces and to be returned to the "b" contact side when the supplied ice pieces are consumed, while the washing timer TM is normally retained at the "b" contact side to be switched over to the "a" contact side when applied with the halt signal of the ice making operation and to be returned to the "b" contact side for restart of the ice making operation after the predetermined time.

In the above embodiment, the ice compacted in the extrusion head 13 is molten by energization of the electric heater 15 when the ice making operation has been halted to discharge the supplied water for washing of the freezing housing 11 and is further molten by energization of the electric heater 15 when the ice making operation is restarted. This is effective to ensure ventilation at the upper end portion of evaporator housing 11. It is, therefore, able to ensure the drain of supplied water and the supply of fresh water for sufficient washing of the evaporator housing and to prevent the evaporator housing 11 from excessive freeze caused by shortage of the supply of fresh water. In addition, the electric heater 15 is automatically deenergized after lapse of the predetermined time at each time when it has been energized. This is useful to reduce consumption of the electric power caused by energization of the electric heater 15 and to eliminate loss of the energy caused by excessive heating of the extrusion head 13 when the ice making operation is restarted.

In a practical embodiment of the present invention, the washing timer TM may be replaced with a manually operated switch which is normally retained at the "b" contact side to be switched over to the "a" contact side for washing of the evaporator housing 11. With such an arrangement of the manually operated switch, it is able to discharge the supplied water from the evaporator housing 11 at any time in accordance with the water quality or for service of the ice making machine. If the user forgot to return the switch to the "b" contact side, the drain valve 33 would be automatically disconnected from the power source after lapse of the predetermined time when the electric heater 15 is energized.

In the case that the ice making performance of the machine is sufficiently large in relation to the consumption amount of ice, sufficient washing of the evaporator housing 11 is effected only by operation of the ice detection switch 19. In the case that the ice making machine is supplied with fresh water of good quality, the washing timer TM may be eliminated since the washing time can be reduced without any trouble.

In the above embodiment, the contact X41 is normally closed by energization of the relay X4 in a condition where the power source switch 40 has been closed. However, if the load acting on the ice making machine increases due to compaction of the ice caused by unexpected trouble of the ice detection switch 19 or defacement of the support bearings of the auger shaft 12, a protector 46 is disconnected to deenergize the relay X4. Thus, the contact X41 is opened to deenergize the relays X1, X2 thereby to open the contacts X11, X21. This causes the geared motor 16 and refrigerant compressor 20 to deactivate for stopping the ice making operation. Simultaneously, the contacts X12, X14 are closed to energize the electric heater 15 and to open the drain valve 33, while the contact X42 of relay X4 is opened. Thus, the water supply valve 32 is maintained in its closed condition.

Figure 3:
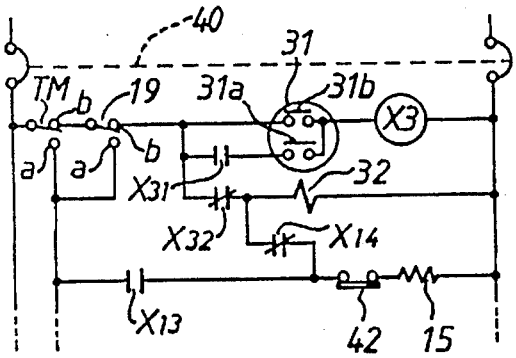
FIG. 3 is a diagram of a modification of the electric control circuit shown in FIG. 2.

Illustrated in FIG. 3 is a modification of the above embodiment wherein the float switch 31 and contact X31 are connected to the electric power source through the washing timer TM and the ice detection switch 19. In a condition where the washing timer TM and ice detection switch 19 are retained at their "b" contact sides, the same operation as that in the above embodiment is effected. When either one of the washing timer TM or the ice detection switch 19 is switched over to the "a" contact side, the ice melting heater 15 is energized and the relay X3 is immediately deenergized regardless of the water level in tank 30. When the contact X33 is opened by energization of the relay X3, the electronic timer of timer board 45 is immediately operated to halt the refrigerant compressor 20 after lapse of the first predetermined time, to halt the geared motor 16 after further lapse of the second predetermined time, to deenergize the electric heater 15 after halt of the geared motor 16 and to open the drain valve 33. Thus, the energization time of the heater 15 during halt of the ice making operation is controlled to correspond with the delay time (for instance, 90 seconds+60 seconds) for halting the geared motor 16 under control of the timer board 45. As a result, the energization time of the electric heater 15 is shortened by the consumption time of the ice making water.

Figure 4:
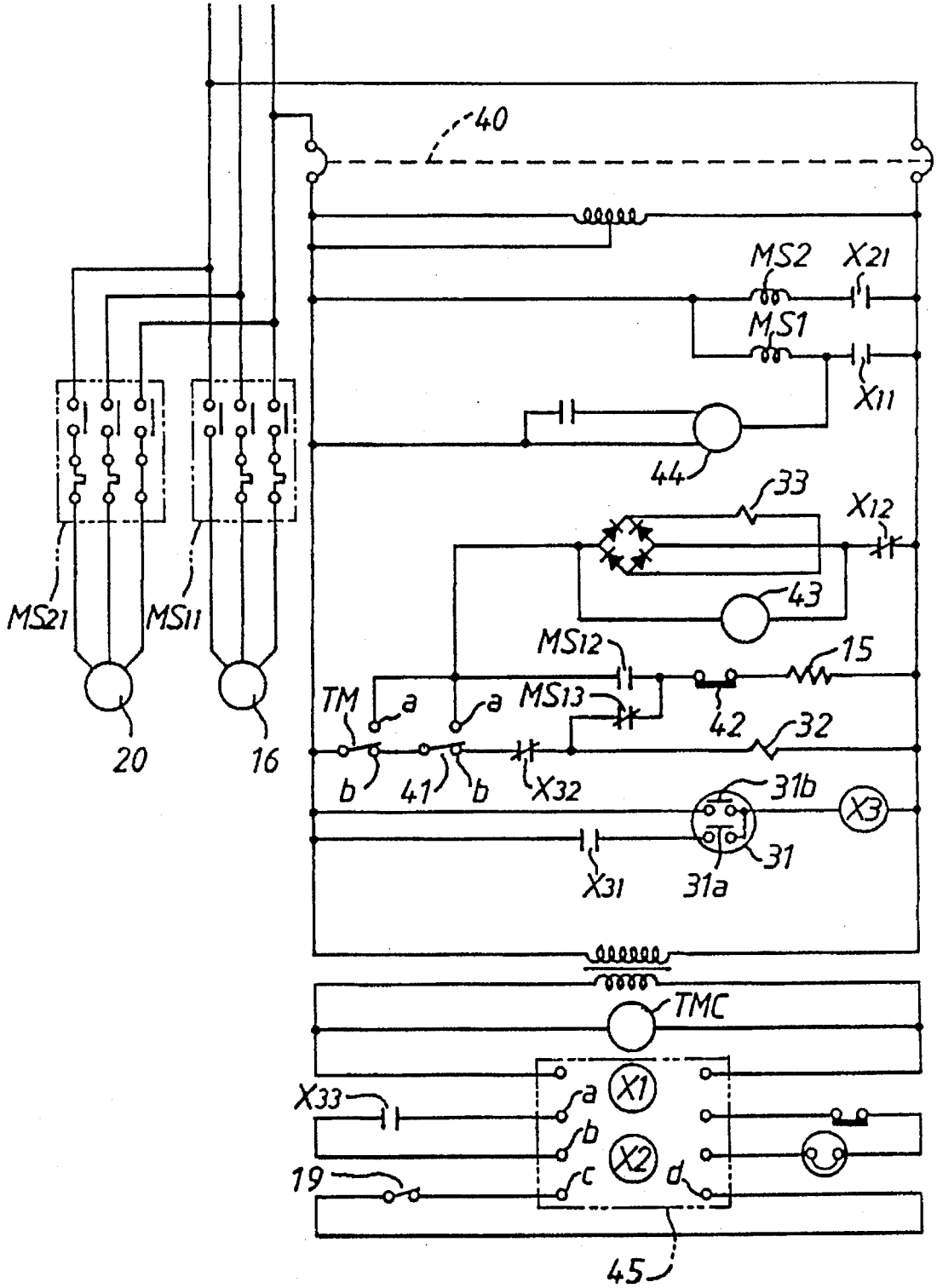
FIG. 4 is a diagram of another modification of the electric control circuit shown in FIG. 2.

In FIG. 4 there is illustrated a modification of the electric control circuit shown in FIG. 2, wherein the geared motor 16, refrigerant compressor 20, water supply valve 32, drain valve 33 and cooling fan 44 are operated under control of the float switch assembly 31, ice detection switch 19, washing timer TM and a washing switch 41. When compared with the electric control circuit of FIG. 2, the washing switch 41 is newly added, and the ice detection switch 19 is placed at a different position. In this modification, the washing timer TM has an operation coil TMC which is energized substantially in the same manner as in the electric control circuit of FIG. 2 when the power source switch 40 has been closed, and the ice detection switch 19 is normally closed to be opened when detected the ice accumulated in the ice storage bin. The washing switch 41 is connected in series with the washing timer TM and is normally retained at an "a" contact side to be manually switched over to a "b" contact side for washing of the evaporator housing 11.

Assuming that the power source switch 40 has been closed, the water valve 32 is opened by the power applied thereto through the washing timer TM, washing switch 41 and the contact X32 of relay X3. Thus the water tank 30 is supplied with fresh water from the water source through the water valve 32. In this instance, the electric heater 15 is energized by the electric power applied through a normally closed contact MS13 of an electromagnetic switch MS1. When the water level in tank 30 rises up to the upper limit level by supply of the fresh water, the upper level switch **31*b* is closed to energize the relay X3. Thus, the contact X32 is opened by energization of the relay X3 to close the water valve 32 and to deenergize the electric heater is The energization time of the heater 15 at start of the ice making operation is the same in the above embodiment. When the contact X33 has been closed by energization of the relay X3, the terminals "a" and "b" of the timer board 45 is shorted to activate the electronic timer in the timer board 45. In this instance, the relay X1 is first energized in a short time (for instance, one second) to close the contact X11. As a result, the geared motor 16 is activated by the electric power applied through the electromagnetic switch MS1 and its contacts MS11, and the relay X2 is energized after lapse of the predetermined time (for instance, 60 seconds) to close the contact X21 so that the refrigerant compressor 20 and cooling fan 44 are activated by the electric power applied through the electromagnetic switch MS2 and its contacts MS21** to start ice making operation of the machine.

When the water level in tank 30 lowers below the lower limit level due to consumption of the water in the ice making operation, the lower level switch **31*a* is opened to deenergize the relay X3. When the contact X32 is, opened by the deenergization of relay X3, the water valve 32 is opened to start supply of fresh water into the water tank 30. In this instance, the contact X33 is opened by deenergization of the relay X3 but the relays X1, X2 are still being energized for a predetermined time during which the water level in tank 30 rises up to the upper limit level to close the upper level switch 31*b* for energization of the relay X3. Thus, the contact X32 is opened by energization of the relay X3 to close the water valve 32. In such a condition, the water level in tank 30 is maintained in the range between the upper and lower limit levels to continue the ice making operation, and the electric heater 15** is maintained in its deenergized condition.

When the washing timer TM is switched over to the "a" contact side at the predetermined time interval, the electric heater 15 is energized by the electric power applied through the contact MS12 of the energized electromagnetic switch MS1 to heat the upper end portion of evaporator housing 11 during operation of the washing timer TM. In this instance, the ice making operation is continued to lower the water level in tank 30. When the water level in tank 30 lowers below the lower limit level, the lower level switch **31*a* is opened to deenergize the relay X3. Thus, the contact X32 is closed by deenergization of the relay X3 but the water valve 32 is maintained in its closed condition since the washing timer TM is retained at the "a" contact side. While the contact X33 is being opened by deenergization of the relay X3, the timer board 45 acts to deenergize the relay X2 after lapse of the first predetermined time (for instance, 90 seconds) and to deenergize the relay X1 after further lapse of the second predetermined time (for instance, 60 seconds). Thus, the refrigerant compressor 20 and geared motor 16 are successively halted, the electric heater 15 is deenergized and the drain valve 33 is opened to discharge the supplied water from the evaporator housing 11 and the water supply system. In such a condition, the ice compacted in the extrusion head 13 is molted by energization of the electric heater 15 to ensure ventilation at the upper end portion of evaporator housing 11 thereby to ensure discharge of the supplied water from the evaporator housing 11**. In this modification, the energization time of the ice melting heater is is controlled in the same manner as in the above embodiment.

When the washing timer TM is returned to the "b" contact side after lapse of a predetermined time, the relay X1 is energized under control of the timer board 45 to open the contact X12 thereby to close the drain valve 33. Thereafter, the water supply valve 32 is opened by the power applied through the contact 32 to supply fresh water into the water tank 30, and the electric heater 15 is energized. When the water level in tank 30 rises up to the upper limit level, the upper level switch **31*b* is closed to energize the relay X3. Thus, the contact X32 is opened to close the water supply valve 32 and to deenergize the electric heater 15. Simultaneously, the contact X33 is closed to activate the geared motor 16 under control of the electronic timer in the timer board 45 and to activate the refrigerant compressor 20** after lapse of the predetermined time thereby to restart the ice making operation.

If in the above-described operation the ambient temperature was low or the washing switch 41 was returned to the "b" contact side in a short time, the ice compacted in the extrusion head 13 would not be fully molten. In this modification, however, the extrusion head 13 is heated by the electric heater 15 until the water level in tank 30 rises up to the upper limit level. Thus, the ice compacted in the extrusion head 13 can be fully molten to ensure ventilation at the upper end portion of evaporator housing 11 thereby to ensure supply of the fresh water into the evaporator housing 11 from the water tank 30. This is effective to avoid excessive freeze of the evaporator housing 11 caused by insufficient supply of the water at restart of the ice making operation.

In the modification shown in FIG. 4, the water drain and washing of the evaporator housing 11 are conducted in such a manner that the supplied water is discharged from the evaporator housing 11 and the water supply system when the washing timer TM is switched over to the "a" contact side to halt the ice making operation and that the evaporator housing 11 is supplied with fresh water when the washing timer TM is returned to the "b" contact side to restart the ice making operation. In the electric control circuit shown in FIG. 4, a manually operated washing switch 41 is connected in series with the washing timer TM. In operation, the washing timer TM is normally retained at the "b" contact side to be periodically switched over to the "a" contact side and returned to the "b" contact side, while the washing switch 41 is normally retained at a "b" contact side to be manually switched over to an "a" contact side at an appropriate time and returned to the "b" contact side. Thus, the water drain and washing of the evaporator housing are conducted in the same manner as described above.

When the internal pressure in discharge duct 18 increases due to the ice pieces discharged from the evaporator housing 11 after the ice storage bin has been filled with the ice pieces supplied by the ice making operation of the machine, the ice detection switch 19 is opened to issue a halt signal of the ice making operation. As a result, the terminals "c" and "d" of the timer board 45 are shorted to activate the electronic timer of the timer board 45, and the relays X2, X1 are deenergized under control of the electronic timer after lapse of a predetermined time so that the refrigerant compressor 20 and geared motor 16 are successively deactivated to halt the ice making operation. When the ice pieces in the ice storage bin are consumed, the ice detection switch 19 is closed to activate the electronic timer of the timer board 45 to restart the ice making operation. In this instance, the relays X1, X2 and electromagnetic switches MS1, MS2 are operated under control of the electronic timer to activate the geared motor 16 and to activate the refrigerant compressor 20 and cooling fan 44 after lapse of the predetermined time. In this modification, the water drain and washing of the evaporator housing 11 may not be conducted during halt of the ice making operation.

In the modification described above, the ice compacted in the extrusion head 13 is fully molted y energization of the electric heater 15 when the ice making operation has been halted to discharge the supplied water for washing of the evaporator housing 11. This is effective to ensure ventilation at the upper end portion of evaporator housing 11 thereby to enhance the washing effect and effective to prevent, the evaporator housing 11 from excessive freeze caused by shortage of the supply of fresh water. In addition, the electric heater 15 is automatically deenergized after lapse of the predetermined time at each time when it has been energized. This is useful to reduce consumption of the electric power caused by energization of the electric heater 15 and to eliminate loss of the energy caused by excessive heating of the extrusion head 13 when the ice making operation is restarted.

With the washing switch 41, it is able to discharge the supplied water from the evaporator housing 11 at any time in accordance with the water quality or for service of the ice making machine. Even if the user forgot to return the washing switch 41 to the "b" contact side, the electric heater 15 would be automatically deenergized after lapse of the predetermined time. Thus, the power consumption caused by energization of the electric heater 15 can be reduced.

Figure 5:
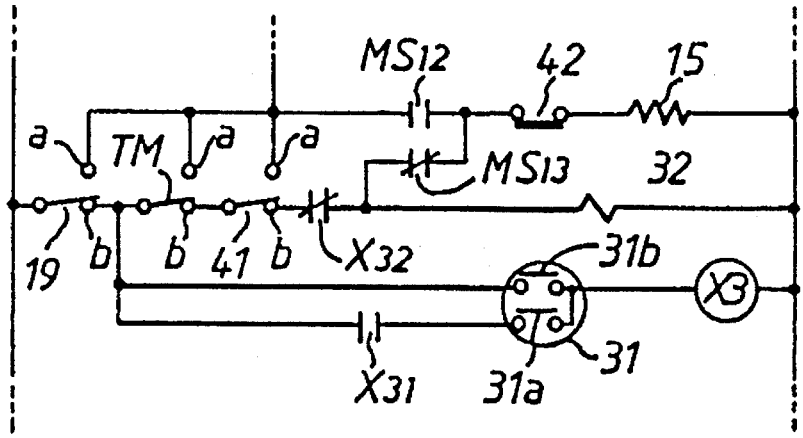
FIGS. 5 to 8 illustrate modifications of the electric control circuit shown in FIG. 4.

In FIG. 5 there is illustrated a modification of a portion of the washing timer TM and washing switch 41 in the electric control circuit shown in FIG. 4, wherein the same ice detection switch 19 as that shown in FIG. 2 is connected in series with the washing timer TM to conduct washing of the evaporator housing 11 during halt of the ice making operation.

Figure 6:
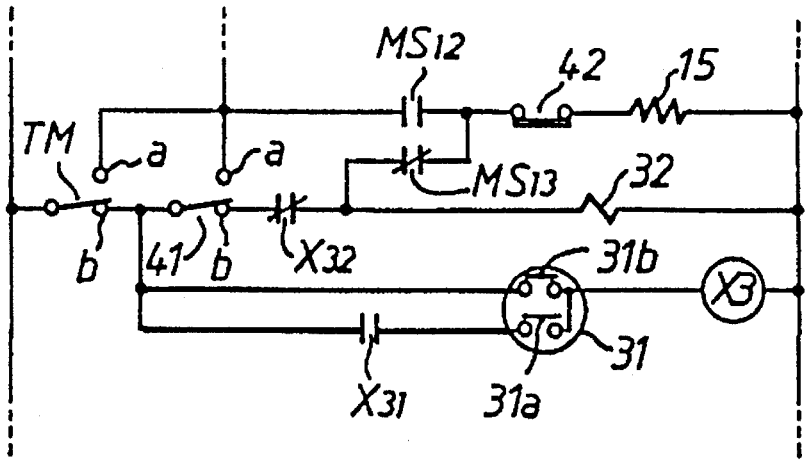

In FIG. 6 there is illustrated another modification of the electric control circuit shown FIG. 4, wherein the level switches 31*a*, 31*b* of float switch assembly 31 and the contact X31 of relay X3 are connected to the power source line through the washing timer TM. In a condition where the washing timer TM is retained at the "b" contact side, the same operation as that in the electric control circuit of FIG. 4 is conducted. When the washing timer TM is switched over to the "a" contact side, the electric heater 15 is energized, and the relay X3 is immediately deenergized regardless of the water level in tank 30. Thus, the contact X33 is opened to activate the electronic timer of the timer board 45 thereby to halt the refrigerant compressor 20 after lapse of the predetermined time and to halt the geared motor 16 after further lapse of the predetermined time. When the washing timer TM is returned to the "b" contact side, the electric heater 15 is deenergized, and the drain valve 33 is opened. Accordingly, the energization time of the electric heater 15 during halt of the ice making operation is controlled to correspond with the delay time (for instance, 90 seconds+60 seconds) for halting the geared motor 16 under control of the timer board 45. As a result, the energization time of the electric heater 15 is shortened by the consumption time of the ice making water.

Figure 7:
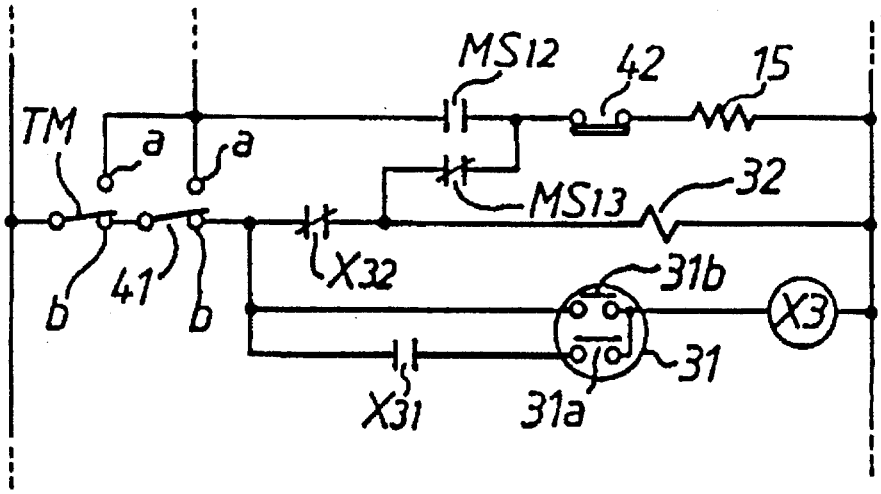

In FIG. 7 there is illustrated a further modification of the electric control circuit shown in FIG. 4, wherein the level switches 31*a*, 31*b* of the float switch assembly 31 and the contact X31 of relay X3 are connected to the power source line through the washing timer TM and washing switch 41. In a condition where the washing timer TM and washing switch 41 are retained at their "b" contact sides, the same operation as that in the electric control circuit of FIG. 4 is conducted. When the washing timer TM and washing switch 41 are switched over to their "a" contact sides, the electric heater 15 is energized, and the relay X3 is immediately deenergized regardless of the water level in tank 30. Thus, the contact X33 of relay X3 is opened to activate the electronic timer of the timer board 45 thereby to halt the refrigerant compressor 20 after lapse of the predetermined time and to halt the geared motor 16 after further lapse of the predetermined time. When the washing timer TM and washing switch 41 are returned to their "b" contact sides, the electric heater 15 is deenergized, and the drain valve 33 is opened. Accordingly, the energization time of the electric heater 15 during halt of the ice making operation is controlled to correspond with the delay time for halting the geared motor 16 under control of the timer board 45. As a result, the energization time of the electric heater 15 is shortened by the consumption time of the ice making water.

Figure 8:
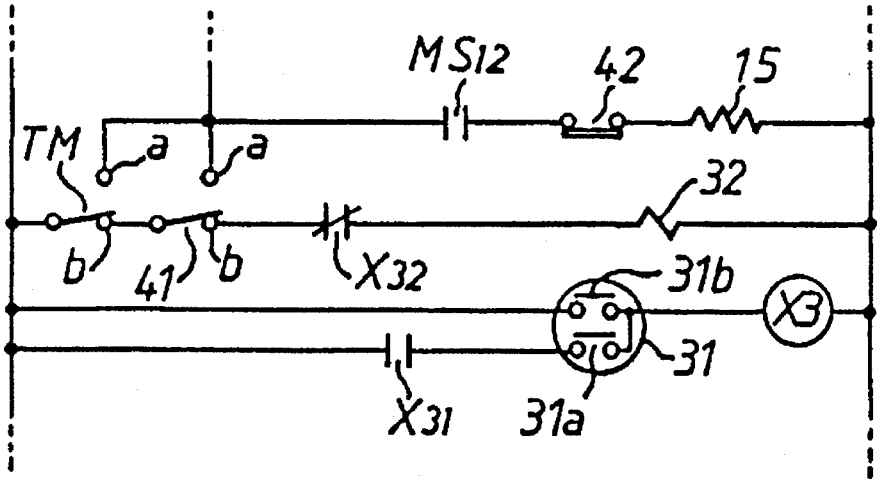

In FIG. 8, there is illustrated a still another modification of the electric control circuit shown in FIG. 4, wherein the contact MS13 is removed to prohibit energization of the electric heater 15 at start of the ice making operation.

Figure 9:
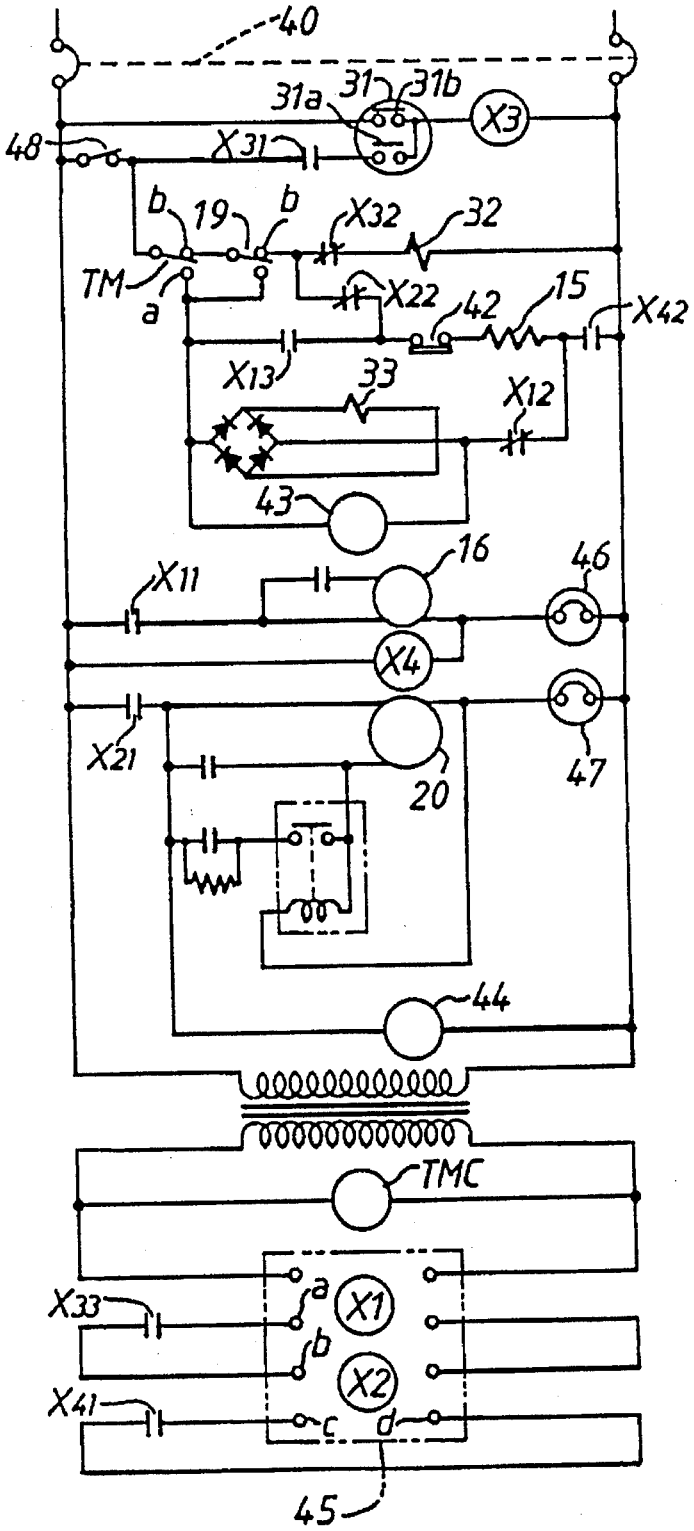
FIG. 9 is a diagram of another embodiment of an auger type ice making machine.

In FIG. 9 there is illustrated another modification of the electric control circuit shown in FIG. 2, wherein an ice making switch 48 is connected in series with the ice detection switch 19 and the contact X31 of relay X3 to control the ice making operation, the contact X14 of relay X1 is replaced with a contact X22 of relay X2 to prolong the energization time of the electric heater 15 at start of the ice making operation, and a contact X42 of relay X4 is connected in series with the electric heater 15 and the drain valve 33.

Assuming that the power source switch 40 and ice making switch 48 in this mollification have been closed, the water supply valve 32 is opened by the electric power applied through the contact X32 of relay X3 to supply fresh water into the water tank 30, and the electric heater 15 is energized by the electric power applied through the contact X22 of relay X2, the bimetal thermal sensor 42 and the contact X42 of relay X4. When the water level in tank 30 rises up to the upper limit level, the upper level switch 1*b* of float switch assembly 31 is closed to energize the relay X3. When the normally closed contact X32 is opened by energization of the relay X3, the water supply valve 32 is closed while the energization of electric heater 15 is maintained by the electric power applied through the contact X22 of relay X2. When the normally open contact X33 is closed by energization of the relay X3, the electronic timer of the timer board 45 is activated in such a manner as described above to energize first the relay X1. In turn, the contact X11 is closed by energization of the relay X1 to activate the geared motor 16. After lapse of the predetermined time (for instance, 60 seconds), the relay X2 is energized under control of the electronic timer to close the contact X21 so that the refrigerant compressor 20 and cooling fan 44 are activated to start ice making operation of the machine. Simultaneously, the normally closed contact X22 is opened by energization of the relay X2 to deenergize the electric heater 15. Accordingly, the energization time of electric heater 15 is controlled to correspond with the sum of the supply time of fresh water and the delay time determined by the timer board 45 for activation of the refrigerant compressor 20 (the time (60 seconds) during which the refrigerant compressor 20 starts to operate after the contact X33 of relay X3 has been closed.

If the load acting on the ice making machine increases due to compaction of the ice caused by unexpected trouble of the ice detection switch 19 or defacement of the support bearings of the auger shaft 12, the protector fuse 46 is disconnected to deenergize the relay X4. Thus, the contact X41 is opened to de:energize the relays X1, X2 thereby to open the contacts X11, X21. This causes the geared motor 16 and refrigerant compressor 20 to deactivate for stopping the ice making operation. Simultaneously, the contacts X12, X22 are closed whereas the contact X22 is opened to prohibit energization of the electric heater 15 and to maintain the drain valve in its closed condition. If the washing timer TM was switched over to the "a" contact side after disconnection of the protector fuse 46, the contacts X13, X42 would be maintained in their open positions to prohibit supply of the electric power to the electric heater 15 and drain valve 33.

Since the protector 46 for geared motor 16 is of the manual return type for prevention of serious accident and is reset after inspection and repair of a damaged portion of the ice making machine, the ice making operation is halted for a long time in operation of the protector 46. In such a situation, the energization of electric heater 15 and the drain of water becomes meaningless. On the other hand, a protector 47 for the refrigerant compressor 20 is of the self-return type. Thus, if the protector 47 is operated, only the refrigerant compressor 20 is stopped regardless of the relays X1, X2. Since the contacts X12, X22 are opened even if the contact X42 is being closed, the electric heater 15 and drain valve 33 may not be applied with the electric power, and the protector 47 is automatically returned to continue the ice making operation. In this instance, the energization of electric heater 15 and the drain of water is meaningless.

In case the protectors 46, 47 are operated due to an overload caused by a trouble of the ice making machine, the ice making operation is halted during which the electric heater 15 and drain valve 33 may not be supplied with the electric power to avoid useless consumption of the electric energy and the ice making water. When the protectors are repeatedly operation, the electric energy and the ice making water are greatly saved. In the case that the ice making machine is installed as an area where the quality of the water source is low, the washing timer TM is adjusted to be switched over to the "a" contact side at a short time interval.

What is claimed is:

1. An auger type ice making machine having an upright evaporator housing the interior of which is formed with a cylindrical freezing surface, an auger mounted for rotary movement within the evaporator housing and drivingly connected at its lower end with an electric motor to scrape ice crystals off the freezing surface and to advance the scraped ice crystals toward an upper end of the evaporator housing, an extrusion head fixed in place within the upper end portion of the evaporator housing to compress the ice crystals advanced thereto by rotation of the auger and extrude the compressed ice crystals upwardly, a discharge pipe provided with an electrically operated drain valve and connected to a lower end portion of the evaporator housing to discharge supplied water from the evaporator housing when the drain valve is opened by its energization, an electric heater mounted on an outer periphery of the evaporator housing at a place corresponding with the extrusion head, detection means for issuing a halt signal of ice making operation of the machine when an ice storage bin of the machine is filled with the ice supplied with the evaporator housing, and control means for halting the electric motor when applied with the halt signal, wherein said control means comprises means for energizing said electric heater when applied with the halt signal from said detection means and means for deenergizing said electric heater after lapse of a predetermined time and for energizing said drain valve after or before lapse of the predetermined time.

2. An auger type ice making machine as claimed in claim 1, wherein said detection means is a stored ice detection switch arranged to be operated for issuing a halt signal of ice making operation of the machine when a predetermined amount of ice is stored in said ice storage bin.

3. An auger type ice making machine as claimed in claim 1, further comprising a washing timer to be operated at a predetermined time interval for issuing a halt signal of ice making operation of the machine, wherein said electric heater is energized in response to the halt signal applied from said washing timer and deenergized after lapse of the predetermined time and said drain valve is energized after or before lapse of the predetermined time.

4. An auger type ice making machine as claimed in claim 1, wherein said control means comprises means for deenergizing said electric heater when said electric motor has been halted by the halt signal applied from said detection means.

5. An auger type ice making machine having an upright evaporator housing the interior of which is formed with a cylindrical freezing surface, an auger mounted for rotary movement within the evaporator housing and drivingly connected at its lower end with an electric motor to scrape ice crystals off the freezing surface and to advance the scraped ice crystals toward an upper end of the evaporator housing, an extrusion head fixed in place within the upper end portion of the evaporator housing to compress the scraped ice crystals advanced thereto by rotation of the auger and extrude the compressed ice crystals upwardly, a discharge pipe provided with an electrically operated drain valve and connected to a lower end portion of the evaporator housing to discharge supplied water from the evaporator housing when the drain valve is opened by its energization, an electric heater mounted on an outer periphery of the evaporator housing at a place corresponding with the extrusion head, and control means for supplying fresh water into the evaporator housing when applied with a start signal of ice making operation in a condition where the drain valve is closed and for stopping the supply of fresh water when the water level in the evaporator housing rises up to a predetermined level, wherein said control means comprises means for energizing said electric heater when applied with the start signal of ice making operation and for deenergizing said electric heater after lapse of a predetermined time.

6. An auger type ice making machine as claimed in claim 5, further comprising a stored ice detection switch arranged to be operated for issuing a start signal of ice making operation when the ice stored in an ice storage bin of the machine decreases below a predetermined mount, wherein said electric heater is energized when applied with the start signal from said detection switch and deenergized after lapse of the predetermined time.

7. An auger type ice making machine as claimed in claim 5, further comprising a washing timer to be operated for issuing a start signal of ice making operation at a predetermined time interval, wherein said electric heater is energized when applied with the start signal from said washing timer and is deenergized after lapse of the predetermined time.

8. An auger type ice making machine as claimed in claim 5, wherein said control means comprises means for deenergizing said electric heater when the supply of fresh water into said evaporator housing has been stopped.

9. An auger type ice making machine having an upright evaporator housing the interior of which is formed with a cylindrical freezing surface, an auger mounted for rotary movement within the evaporator housing and drivingly connected at its lower end with an electric motor to scrape ice crystals off the freezing surface and to advance the scraped ice crystals toward an upper end of the evaporator housing, an extrusion head fixed in place within the upper end portion of the evaporator housing to compress the scraped ice crystals advanced thereto by rotation of the auger and extrude the compressed ice crystals upwardly, a discharge pipe provided with an electrically operated drain valve and connected to a lower end portion of the evaporator housing to discharge supplied water from the evaporator housing when the drain valve is opened by its energization, an electric heater mounted on an outer periphery of the evaporator housing at a place corresponding with the extrusion head, detection means for issuing a halt signal of ice making operation of the machine when an ice storage bin of the machine is filled with the ice supplied from the evaporator housing, and control means for halting the electric motor when applied with the halt signal and for energizing the drain valve and the electric heater when the electric motor has been halted, wherein said control means comprises protector means for issuing a halt signal of ice making operation when detected an excessive load acting on the ice making machine and means for prohibiting energization of said drain valve and said electric heater when applied with the halt signal from said protector means.

* * * * *